US009583252B2

(12) United States Patent
Weber et al.

(10) Patent No.: US 9,583,252 B2
(45) Date of Patent: Feb. 28, 2017

(54) TRANSFORMER

(71) Applicant: ABB Technology AG, Zürich (CH)

(72) Inventors: Benjamin Weber, Winterberg (DE); Frank Cornelius, Brilon (DE); Jiahua Zhang, Brilon (DE); Martin Carlen, Niederrohrdorf (CH); Thorsten Steinmetz, Baden-Dättwil (CH)

(73) Assignee: ABB Schweiz AG, Baden (CH)

( * ) Notice: Subject to any disclaimer, the term of this patent is extended or adjusted under 35 U.S.C. 154(b) by 197 days.

(21) Appl. No.: 14/514,980

(22) Filed: Oct. 15, 2014

(65) Prior Publication Data

US 2015/0109085 A1 Apr. 23, 2015

(30) Foreign Application Priority Data

Oct. 18, 2013 (EP) ..... 13 004 986

(51) Int. Cl.

| | |
|---|---|
| ***H01F 30/12*** | (2006.01) |
| ***H01F 21/02*** | (2006.01) |
| ***H01F 27/26*** | (2006.01) |
| ***H01F 27/38*** | (2006.01) |
| ***H01F 29/02*** | (2006.01) |
| ***H01F 41/02*** | (2006.01) |
| ***H01F 41/06*** | (2016.01) |
| *H01F 27/28* | (2006.01) |

(52) U.S. Cl.

CPC ..... *H01F 27/263* (2013.01); *H01F 27/38* (2013.01); *H01F 29/02* (2013.01); *H01F 29/025* (2013.01); *H01F 41/0206* (2013.01); *H01F 41/06* (2013.01); *H01F 27/28* (2013.01); *Y10T 29/49071* (2015.01)

(58) Field of Classification Search

CPC ..... H01F 29/025
USPC ..... 336/5, 145
See application file for complete search history.

(56) References Cited

U.S. PATENT DOCUMENTS

| | | | | |
|---|---|---|---|---|
| 1,677,003 | A * | 7/1928 | Owen | H01F 38/085 336/145 |
| 5,202,664 | A * | 4/1993 | Poulsen | H01F 27/324 336/213 |
| 6,809,620 | B2 * | 10/2004 | Hoglund | H01F 3/06 336/213 |
| 2010/0194515 | A1 * | 8/2010 | Hurst | H01F 27/23 336/212 |

(Continued)

*Primary Examiner* — Elvin G Enad
*Assistant Examiner* — Ronald Hinson
(74) *Attorney, Agent, or Firm* — Barnes & Thornburg LLP

(57) ABSTRACT

A transformer and a method of manufacturing a transformer are disclosed. The transformer can include a transformer core with at least three core limbs which are arranged in parallel with respect to one another and perpendicular to corner points of an area spanned by a polygon, and wherein axial end regions of each of the at least three core limbs transition into a respective yoke segment arranged transversely with respect to the axial end regions. Main windings can be arranged around each of the at least three core limbs in a hollow-cylindrical winding region. A magnetic cross section of a respective core limb can be greater than a magnetic cross section of the respective yoke segment. Additional windings can be electrically connected to a respective main winding and can be arranged around each of the respective yoke segments.

20 Claims, 3 Drawing Sheets

(56) References Cited

U.S. PATENT DOCUMENTS

2012/0139678 A1* 6/2012 Outten ..... H01F 41/08
336/5
2013/0328652 A1* 12/2013 Outten ..... H01F 27/245
336/5

* cited by examiner

TRANSFORMER

RELATED APPLICATION(S)

This application claims priority under 35 U.S.C. §119 to European Patent Application No. 13004986.9 filed in Europe on Oct. 18, 2013, the entire content of which is hereby incorporated by reference in its entirety.

FIELD

The disclosure relates to a transformer, including a transformer core with at least three core limbs which are arranged in parallel with respect to one another and perpendicular to the corner points of a basic area spanned by a polygon, the respective two axial end regions of which core limbs transition on both sides into a respective yoke segment arranged transversely with respect thereto and in each case a main winding arranged around a respective core limb in a hollow-cylindrical winding region, wherein the magnetic cross section of a respective core limb can be greater than the magnetic cross section of a respective yoke segment.

BACKGROUND INFORMATION

Known transformers can be used in electrical energy distribution systems in order to couple power supply units with different voltage levels to one another. Transformers can be designed as dry-type transformers with a voltage level close to a consumer or generator and can have nominal voltages, for example, in the range from, for example, 1 kV to 6 kV on the low-voltage side and nominal voltages in the range from, for example, 10 kV to 30 kV on the high-voltage side, wherein corresponding nominal powers lie in the range from, for example, 0.5 MVA to 10 MVA. However, transformers such as this can be used in the field of wind power installations, where the nominal power of a transformer is directed towards the power of an associated wind power installation.

Due to the high nominal currents in the low-voltage range, which can be, for example, some 100 A, the low-voltage windings can be designed in a manner wound from a ribbon conductor, wherein the width of a ribbon conductor corresponds to at least the complete axial length of a respective transformer winding. Depending on the embodiment and specifications on the transformer, the number of low voltage-side turns can be, for example, in the region of ten turns, for example, in applications for wind power installations, where the voltage generated on the generator side can be correspondingly low and can be set to a higher operating level by the transformer.

For the purposes of regulation, a known procedure can be to provide the high voltage-side winding(s) of a transformer with a plurality of taps, which can be selected by a respective on-load tap changer, for example, with the result that the transformation ratio of the transformer can thus be changed within a regulation range. Increased regulability can be needed in applications for wind power installations in order to help ensure the transformer is adapted to the boundary conditions resulting from different wind conditions.

The active part of a transformer can have a closed iron circuit and at least one high-voltage and low-voltage winding with an integer number of closed turns around the respective core limb. The induced voltage per closed conductor loop can be dependent on the mains frequency, flux density and core cross section.

An on-load tap changer arranged on the high-voltage side can be complex to make due to the high voltage demand and that regulation of the voltage can take place minimally in that voltage graduation, which can correspond to the induced voltage of a complete turn. In the case of voltage regulation, the minimum regulation stage can be limited to the voltage difference between two turns. For example, in the case of the low voltage-side ribbon windings disclosed above because, owing to the relatively low total number of turns, for example, in the region of ten, fine regulation around the nominal transformation may not be possible.

In accordance with an exemplary embodiment, the disclosure can provide a transformer which can enable the voltage on the low-voltage side to be regulated in smaller voltage steps, and wherein a corresponding on-load tap changer can be made simpler due to the then lower voltage demand.

SUMMARY

A transformer is disclosed, comprising: a transformer core with at least three core limbs which are arranged in parallel with respect to one another and perpendicular to corner points of an area spanned by a polygon, and wherein axial end regions of each of the at least three core limbs transition into a respective yoke segment arranged transversely with respect to the axial end regions; main windings arranged around each of the at least three core limbs in a hollow-cylindrical winding region, and wherein a magnetic cross section of a respective core limb is greater than a magnetic cross section of the respective yoke segment; and additional windings which are electrically connected to a respective main winding and which are arranged around each of the respective yoke segments.

A method of manufacturing a transformer is disclosed, the method comprising: providing a transformer core with at least three core limbs which are arranged in parallel with respect to one another and perpendicular to corner points of an area spanned by a polygon, and wherein axial end regions of each of the at least three core limbs transition into a respective yoke segment arranged transversely with respect to the axial end regions; winding each of the at least three core limbs with a main winding arranged around a respective core limb in a hollow-cylindrical winding region, and wherein a magnetic cross section of a respective core limb is greater than a magnetic cross section of the respective yoke segment; and electrically connecting additional windings to a respective main winding, the additional windings being arranged around each of the respective yoke segments.

BRIEF DESCRIPTION OF THE DRAWINGS

The disclosure is explained below with reference to the exemplary embodiments shown in the drawings. In the drawings.

DETAILED DESCRIPTION

Figure 1:
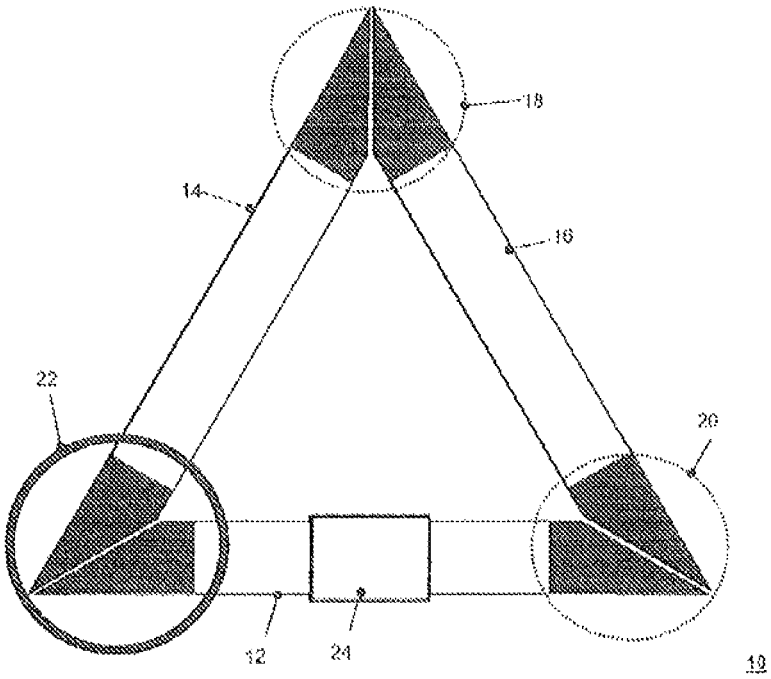
FIG. 1 shows an exemplary first transformer.

In accordance with an exemplary embodiment, a transformer is disclosed which can include an additional winding that can be electrically connected to a respective main winding and which can be arranged around a respectively assigned yoke segment.

In accordance with an exemplary embodiment, a transformer is disclosed which can reduce the induced voltage of one or more complete turns which can be provided for the purposes of regulation in that the turns do not surround the magnetic cross section of a complete core limb, but rather can enclose the cross section of a respective yoke. For example, in the case of a transformer with a polygonal layout, the cross section of a yoke can be smaller, for example, than the cross section of a complete core limb. Thus, the magnetic flux enclosed by a turn and hence the respectively induced voltage can also be lower in the case of the arrangement on a yoke than in the case of the arrangement on a core limb.

In accordance with an exemplary embodiment, by virtue of a corresponding series connection of the main winding, and for example, arranging a selectable number of additional windings around a respective yoke of the transformer core, a finer graduation of the regulation region of the transformer can be achieved.

According to an exemplary embodiment of a transformer according to the disclosure, the transformer core can have the basic area of an equilateral triangle. Such shapes can be known, for example, by the names "hexaformer" or "delta core". A delta core can have, for example, three frame-like segments which can be wound in an annular manner and which, when joined to one another according to a triangular layout, can result in a triangular transformer core. In accordance with an exemplary embodiment, the symmetrical shape of such a transformer core for three-phase transformers can favour a symmetrical operating behaviour, for example.

In accordance with an exemplary embodiment, it can also be seen on a delta core why the cross section of a yoke can be smaller than the cross section of a core limb. The surrounding cross section of a frame-like wound core segment can be identical along its circumference. The cross section of a core limb can be formed from the sum of the cross sections of two sides, which border one another, of adjacent core segments, while a yoke can have the surrounding cross section of a single frame segment, wherein a total of three core limbs and six yokes with in each case half the magnetic cross-sectional area can be formed, According to an exemplary embodiment of the transformer according to the disclosure, the magnetic cross-sectional area of a respective yoke segment can be half the magnetic cross-sectional area of a respective core limb, According to an exemplary embodiment of the transformer according to the disclosure, the main and/or the additional windings can be formed by a respective flat ribbon conductor. Flat ribbon conductors can be suitable for accommodating high currents, which can be advantageous in the case of a respective low voltage-side winding. In addition, flat ribbon conductors can have a correspondingly high fill factor.

According to an exemplary embodiment of the transformer according to the disclosure, at least one winding of a respective additional winding can be guided through a gap in the yoke segment. In accordance with an exemplary embodiment, as a result of this, the induced voltage in the corresponding turn of the additional winding can be reduced further because now only a part of the magnetic cross-sectional area of the yoke is surrounded by the turn and the induced voltage therefore turns out to be correspondingly lower. Thus, in accordance with an exemplary embodiment, a refinement of the graduation sections about the nominal transformation can be enabled in a simple manner, for example a regulation region of, for example, +/−15% in steps of in each case, for example, 1.5%.

In accordance with an exemplary embodiment, a yoke can be suitable to be divided into two cross-sectional areas by a gap at least along a section of the axial extent of the yoke because an increase, caused thereby, in the geometric cross section (in the case of a magnetic cross section which remains the same) does not lead to an increase in the installation size of the transformer. If a gap were arranged in the limb region of a transformer, an effective reduction in the magnetic cross section would result at least in the gap region owing to the limited space supply within a coil surrounding the respective limb in the case of a geometric cross section, which can remain the same.

In accordance with an exemplary embodiment, a correspondingly higher number of gaps can be provided and hence also of cross-sectional areas. In accordance with an exemplary embodiment, any subdivision can occur in order to meet the specifications on regulability, for example ⅓ or ¼. Specific voltage stages can also be realized, however, by a plurality of turns being laid around a part of the yoke, for example, 3 turns around ¼ of the yoke cross section or 4 turns around ⅕ of the yoke cross section. If the windings are laid separately around a part of the yoke cross section, the wiring can be used by the selection of the winding direction or the polarity of the (additional) turn in order to enable the turn to work in an either additive or subtractive manner. Hence, the number of (additional) turns for the voltage regulability can be reduced According to an exemplary embodiment of the transformer according to the disclosure, the respective additional winding can be provided with a plurality of taps accessing different turns of the respective additional winding. By appropriate selection of the taps, a desired regulation region can be realized. The additional winding optionally can have a fine graduation region, which can be distinguished by taps from turns, which can be guided through the respective gap in a yoke, of the additional winding. In accordance with an exemplary embodiment, the turns can have in each case an induced voltage, which can be lower than the induced voltage of a turn, which completely surrounds the respective yoke. Furthermore, a coarse graduation region can be provided which can be distinguished by taps from turns, which in each case completely surround the yoke. In accordance with an exemplary embodiment, by appropriate series connection of the coarse and fine graduation regions, fine graduation over a wide range can be achieved.

According to an exemplary embodiment of the transformer according to the disclosure, switching means can be provided in order to selectively connect the main winding to one of the taps of the additional winding, with the result that the number of active turns of the electrically connected main and additional winding can thus be matched. If appropriate, separate switching means can be provided for coarse and fine graduation regions of the additional winding.

According to an exemplary embodiment of the transformer, the switching means can include an on-load tap changer and/or power electronic components. On-load tap changers have proven to be successful as standard components for the optional selection and wiring of taps of a transformer winding. According to specifications, power electronic components such as thyristors or IGBTs can also be provided.

FIG. 1 shows an exemplary first transformer 10 in a sectional view. A triangular transformer core (delta core) can be formed from three frame-like wound core segments of which in each case the lower yoke segment is provided with the reference numeral 12, 14, 16. Respective core limbs 18, 20 can be formed on the contact surfaces of adjacently arranged core segments, which core limbs have twice the cross section of a respective yoke 12, 14, 16, Respective main windings 22 can be arranged around the core limbs 18, 20, which main windings can be electrically connected to additional windings 24, which can be arranged in each case around the yoke segments 12, 14, 16. Voltage regulation of a respective main winding 22 can be refined by the less graduated voltage induction in the additional winding 24.

Figure 2:
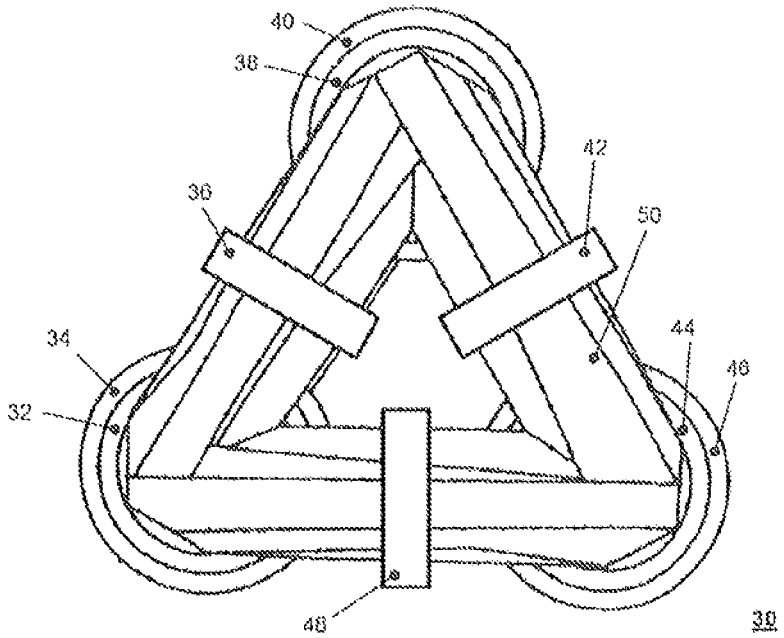
FIG. 2 shows an exemplary second transformer.

FIG. 2 shows an exemplary second transformer 30 in a plan view. The three limbs of a triangular transformer core 50 can be surrounded in a hollow cylindrical manner by mutually interlaced first low voltage-side primary main windings 32, 38, 44, which can be arranged radially on the inside and by high voltage-side secondary main windings 34, 40, 46, which can be arranged radially on the outside. In accordance with an exemplary embodiment, the primary main windings arranged on the low voltage side can be in each case electrically interconnected with additional windings 36, 42, 48 arranged around the respective upper yokes, which additional windings each have a plurality of turns with taps which can be connected to a respective on-load tap changer to adapt the transformation ratio, which is not shown in the figure.

Figure 3:
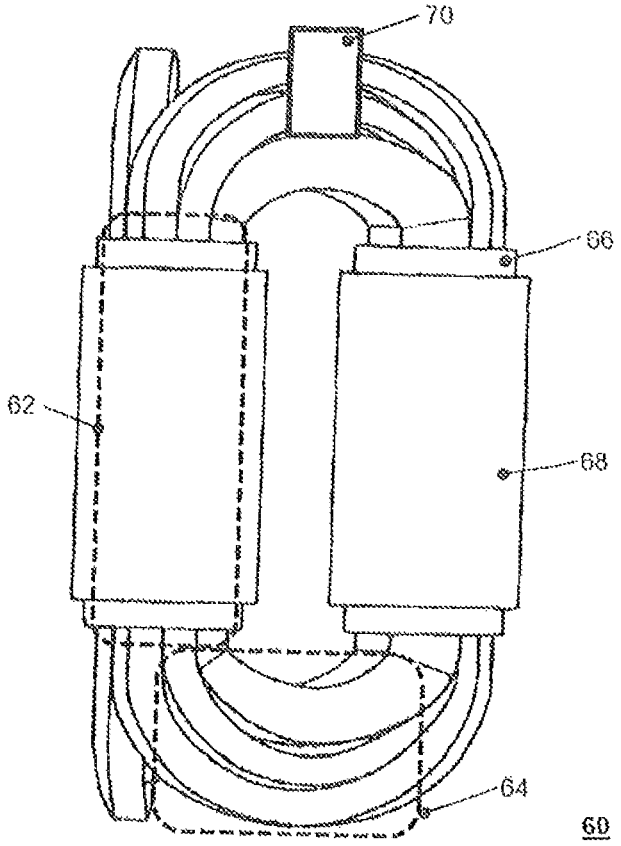
FIG. 3 shows an exemplary third transformer.

FIG. 3 shows a similar transformer 60 to that in FIG. 2 but in a side view. In accordance with an exemplary embodiment, a respective core limb can be distinguished by a dashed rectangle with the reference numeral 62 and a respective yoke segment can be distinguished by a dashed rectangle with the reference numeral 64, wherein both differ from one another in their magnetic cross section by a factor of two. Respective first 66 and second 68 main windings can be arranged around the core limbs 62, which main windings can be electrically connected to additional windings 70, which can be arranged around respective yoke segments 64.

In accordance with an exemplary embodiment, the additional windings 70 can configured such that that they do not encompass the total cross section of a respective yoke; rather they can be guided through a gap in the yoke, with the result that a lower voltage can be induced per turn than if the entire yoke cross section were surrounded. As a result of this, finer voltage regulation can be enabled. The so-called hexaformer core shown here, which can be made from laminated cores, which can be arranged in each case in a bunched and wound manner, lends itself in particular to this purpose because a gap can be provided, for example, in relatively simple manner between adjacent laminated cores in the yoke regions.

Figure 4:
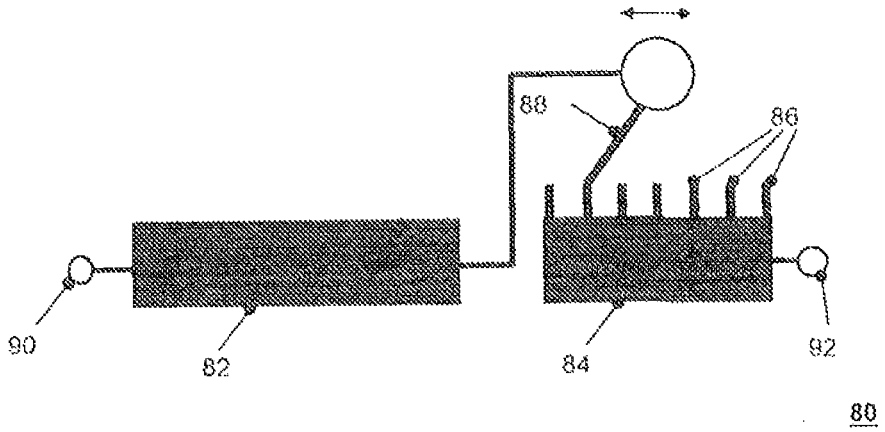
FIG. 4 shows an exemplary wiring of main and additional winding.

FIG. 4 shows an exemplary wiring 80 of a main 82 and additional winding 84. These can be respectively electrically connected in series, wherein the additional winding 84 can have a plurality of taps 86, which can optionally be tapped by means of a switching means 88, and on-load tap changer. Electrical connections 90 and 92, respectively, can be provided at the start and end of the series circuit.

Figure 5:
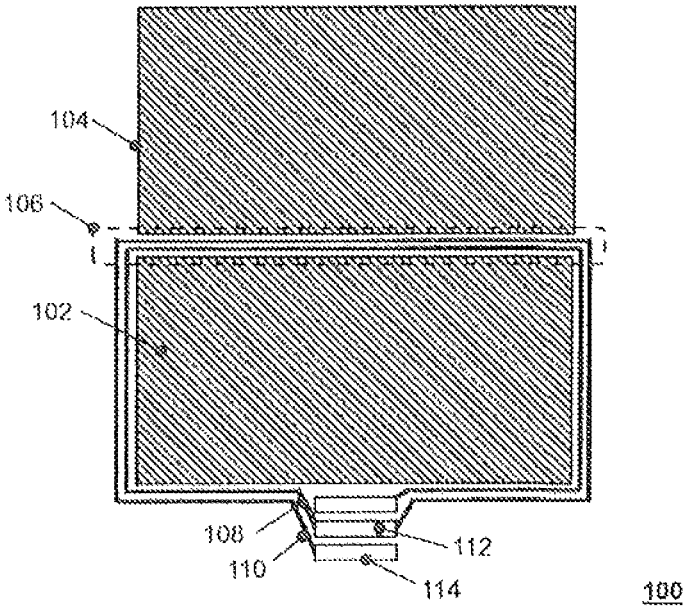
FIG. 5 shows a cross section through an exemplary yoke segment.

FIG. 5 shows a cross section through an exemplary yoke segment 100 the magnetic total cross section of which is formed by a first cross-sectional area 102 and a second cross-sectional area 104, wherein a gap 106 can be provided therebetween, through which gap two turns 108, 110 of an additional winding can be guided. In accordance with an exemplary embodiment, the additional winding can be connectable via taps 112, 114.

Thus, it will be appreciated by those skilled in the art that the present invention can be embodied in other specific forms without departing from the spirit or essential characteristics thereof. The presently disclosed embodiments are therefore considered in all respects to be illustrative and not restricted. The scope of the invention is indicated by the appended claims rather than the foregoing description and all changes that come within the meaning and range and equivalence thereof are intended to be embraced therein.

LIST OF REFERENCE SIGNS

10 exemplary first transformer
12 first yoke segment of the first transformer
14 second yoke segment of the first transformer
16 third yoke segment of the first transformer
18 cross section of the first core limb of the first transformer
20 cross section of the second core limb of the first transformer
22 first main winding of the first transformer
24 first additional winding of the first transformer
30 exemplary second transformer
32 first primary main winding of the second transformer
34 first secondary main winding of the second transformer
36 first additional winding of the second transformer
38 second primary main winding of the second transformer
40 second secondary main winding of the second transformer
42 second additional winding of the second transformer
44 third primary main winding of the second transformer
46 third secondary main winding of the second transformer
48 third additional winding of the second transformer
50 transformer core
60 exemplary third transformer
62 first core limb of the third transformer
64 first yoke segment of the third transformer
66 first primary main winding of the third transformer
68 first secondary main winding of the third transformer
70 first additional winding of the third transformer
80 exemplary wiring of main and additional winding
82 exemplary main winding
84 exemplary additional winding
86 taps
88 switching means
90 first connection
92 second connection
100 cross section through the exemplary yoke segment
102 first cross-sectional area
104 second cross-sectional area
106 gap
108 first turn of additional winding
110 second turn of additional winding
112 first tap
114 second tap

What is claimed is:

1. A transformer, comprising:

a transformer core with at least three core limbs which are arranged in parallel with respect to one another and perpendicular to corner points of an area spanned by a polygon, and wherein axial end regions of each of the at least three core limbs transition into a respective yoke segment arranged transversely with respect to the axial end regions;

main windings arranged around each of the at least three core limbs in a hollow-cylindrical winding region, and wherein a magnetic cross section of a respective core limb is greater than a magnetic cross section of the respective yoke segment; and additional windings which are electrically connected to a respective main winding and which are arranged around each of the respective yoke segments.

2. The transformer according to claim 1, wherein the transformer core has an area of an equilateral triangle.

3. The transformer according to claim 1, wherein the main windings e formed by a respective flat ribbon conductor.

4. The transformer according to claim 1, wherein the additional windings are formed by a respective flat ribbon conductor.

5. transformer according to claim 1, wherein the transformer core is a hexaformer core or a delta core.

6. The transformer according to claim 1, wherein a magnetic cross-sectional area of a respective yoke segment is half the magnetic cross-sectional area of a respective core limb.

7. The transformer according to claim 1, wherein at least one winding of the additional winding is guided through a gap in the yoke segment.

8. The transformer according to claim 1, wherein each additional winding is provided with a plurality of taps accessing different turns of the additional winding.

9. The transformer according to claim 8, comprising:

switching means for electrically connecting each respective main winding to one of the taps of a respective additional winding, and wherein a number of active turns of the respective electrically connected main and additional winding are matched.

10. The transformer according to claim 9, wherein the switching means comprises:

an on-load tap changer and/or power electronic components.

11. A method of manufacturing a transformer, the method comprising:

providing a transformer core with at least three core limbs which are arranged in parallel with respect to one another and perpendicular to corner points of an area spanned by a polygon, and wherein axial end regions of each of the at least three core limbs transition into a respective yoke segment arranged transversely with respect to the axial end regions;

winding each of the at least three core limbs with a main winding arranged around a respective core limb in a hollow-cylindrical winding region, and wherein a magnetic cross section of a respective core limb is greater than a magnetic cross section of the respective yoke segment; and electrically connecting additional windings to a respective main winding, the additional windings being arranged around each of the respective yoke segments.

12. The method according to claim 11, wherein the transformer core has an area of an equilateral triangle.

13. The method according to claim 11, comprising:

forming the main windings by a respective flat ribbon conductor.

14. The method according to claim 11, comprising:

forming the additional windings by a respective flat ribbon conductor.

15. The method according to claim 11 wherein the transformer core is a hexaformer core or a delta core.

16. The method according to claim 11, wherein a magnetic cross-sectional area of a respective yoke segment is half the magnetic cross-sectional area of a respective core limb.

17. The method according to claim 11, comprising:

guiding at least one winding of the additional winding through a gap in the yoke segment.

18. The method according to claim 11, comprising:

providing each additional winding with a plurality of taps accessing different turns of the additional winding.

19. The method according to claim 18, comprising:

switching means for connecting the respective main winding to one of the taps of the respective additional winding, and wherein a number of active turns of the respective electrically connected main and additional winding are matched.

20. The method according to claim 19, wherein the switching means comprises:

an on-load tap changer and/or power electronic components.

* * * * *